US011072996B2

(12) United States Patent
Buchanan

(10) Patent No.: US 11,072,996 B2
(45) Date of Patent: Jul. 27, 2021

(54) CLEANING WELLBORE PERFORATION CLUSTERS AND RESERVOIR FRACTURES

(71) Applicant: C&J Spec-Rent Services, Inc., Houston, TX (US)

(72) Inventor: Sean C. Buchanan, Sugar Land, TX (US)

(73) Assignee: C&J Spec-Rent Services, Inc., Houston, TX (US)

( * ) Notice: Subject to any disclaimer, the term of this patent is extended or adjusted under 35 U.S.C. 154(b) by 465 days.

(21) Appl. No.: 15/880,711

(22) Filed: Jan. 26, 2018

(65) Prior Publication Data

US 2018/0216439 A1 Aug. 2, 2018

Related U.S. Application Data

(60) Provisional application No. 62/451,308, filed on Jan. 27, 2017.

(51) Int. Cl.

| | |
|---|---|
| ***E21B 37/00*** | (2006.01) |
| ***E21B 37/06*** | (2006.01) |
| *E21B 47/04* | (2012.01) |
| *E21B 34/06* | (2006.01) |

(52) U.S. Cl.
CPC ..... *E21B 37/00* (2013.01); *E21B 37/06* (2013.01); *E21B 34/06* (2013.01); *E21B 47/04* (2013.01)

(58) Field of Classification Search
CPC ..... E21B 34/06; E21B 37/00; E21B 37/06; E21B 47/04
See application file for complete search history.

(56) References Cited

U.S. PATENT DOCUMENTS 5,314,545 A * 5/1994 Folts ..... B08B 9/0433 134/22.11
5,458,197 A 10/1995 Chan
6,170,577 B1 * 1/2001 Noles, Jr. ..... E21B 37/00 134/22.12

(Continued)

OTHER PUBLICATIONS

Khan et al., "Fill Removal with Foam in Horizontal Well Cleaning in Coiled Tubing", Research Journal of Applied Sciences Engineering and Technology, Aug. 10, 2013, 7 pages.

*Primary Examiner* — Daniel P Stephenson
(74) *Attorney, Agent, or Firm* — Egan, Enders & Huston LLP.

(57) ABSTRACT

Methods for cleaning wellbore perforation clusters and reservoir fractures include extending a conduit into a wellbore until the conduit reaches a measured depth deeper than a designated perforation cluster, moving the conduit back and forth between the measured depth and a shallower measured depth, and dispensing different fluids into the wellbore via the conduit during respectively different cycles of the back and forth motion. The fluids may be liquid and/or gas. The conduit is dimensionally configured and arranged within the wellbore such that a passageway exists in the wellbore exterior to the conduit. The methods include closing the passageway prior to, at the same time or subsequent to introducing a gas-containing fluid into the wellbore and continuing to dispense the gas-containing fluid into the wellbore after closing the passageway. Storage mediums having program instructions which are executable by a processor for performing any steps of the methods are also provided.

22 Claims, 5 Drawing Sheets

(56) References Cited

U.S. PATENT DOCUMENTS

| | | | | |
|---|---|---|---|---|
| 6,534,449 | B1 | 3/2003 | Gilmour et al. | |
| 7,377,283 | B2 | 5/2008 | Walker et al. | |
| 7,878,247 | B2 * | 2/2011 | Misselbrook | E21B 43/26 134/23 |
| 2003/0056811 | A1 * | 3/2003 | Walker | B08B 9/0433 134/18 |
| 2012/0234548 | A1 | 9/2012 | Dyer | |
| 2018/0216439 | A1 * | 8/2018 | Buchanan | E21B 37/00 |

* cited by examiner

CLEANING WELLBORE PERFORATION CLUSTERS AND RESERVOIR FRACTURES

PRIORITY CLAIM

The present application claims priority to U.S. Provisional Application No. 62/451,308 filed Jan. 27, 2017, which is incorporated by reference herein.

BACKGROUND OF THE INVENTION

1. Field of the Invention

This invention generally relates to well stimulation and, more specifically, to methods for cleaning wellbore perforation clusters and reservoir fractures.

2. Description of the Related Art

The following descriptions and examples are not admitted to be prior art by virtue of their inclusion within this section.

Well stimulation processes are often needed to increase production flow from wells. In many cases, the well stimulation processes are implemented to clean the well, particularly to remove sediment at the bottom of the well blocking perforation clusters in the wellbore as well as dissolve scaling and/or debris lodged in the perforation clusters and/or along the wellbore. The cleaning processes generally involve circulating carrying and/or acidic fluids through the well and, in some cases, introducing the fluids at relatively high pressures. Although the cleaning processes are generally effective for cleaning the interior walls of the wellbore, their effect on cleaning out the perforation clusters is often inadequate due to the limited ability to circulate the cleaning fluids therein. Moreover, it is generally desirable to circulate cleaning fluids through the well at a relatively high velocity such that sediment may be carried out of the well, but further yet to limit the amount of cleaning fluid entering the perforation clusters. In particular, fluids entering into perforation clusters may leak off into the fractures of the reservoir extending from the wellbore. If such fluids carry suspended debris, the debris could be deposited in the fractures which would likely hinder production flow which is contrary to the objective of well stimulation. In some such cases, a well stimulation procedure may include refracturing processes to make the perforation clusters larger, make new perforation clusters and/or extend reservoir fractures. Although refracturing processes often improve production flow from a well, they are costly, pose a risk to the integrity of the wellbore, and the degree of effectiveness is not statistically quantifiable to justify the imposed costs and risks.

Therefore, it would be advantageous to develop methods for improving well stimulation, particularly techniques which aid in cleaning out wellbore perforation clusters.

SUMMARY OF THE INVENTION

The following description of various embodiments of methods and storage mediums is not to be construed in any way as limiting the subject matter of the appended claims.

Embodiments of methods for cleaning wellbore perforation clusters and reservoir fractures include extending a conduit into a lower portion a wellbore until a forward end of the conduit reaches a first measured depth in the wellbore that is deeper than a designated perforation cluster of the wellbore. The conduit is configured to dispense fluid at its forward end, is configured to prevent back flow of fluid through at least a majority portion of the conduit, and is dimensionally configured and arranged within the wellbore such that a passageway exists in the wellbore exterior to the conduit. The methods further include introducing a fluid into the wellbore through the forward end of the conduit subsequent to the forward end of the conduit passing the designated perforation cluster. In some cases, the methods may include circulating one or more cleaning fluids through the wellbore prior to extending introducing the fluid into the conduit. In some of such cases, the methods may include removing production tubing from the wellbore prior to circulating the one or more cleaning fluids through the wellbore.

Moreover, the methods include retracting the conduit from the first measured depth while dispensing the fluid into the wellbore through the forward end of the conduit and until the forward end of the conduit reaches a second measured depth in the wellbore that is shallower than the designated perforation cluster of the wellbore. Furthermore, the methods include moving the conduit from the second measured depth toward the first measured depth while dispensing the fluid into the wellbore. The fluid may be a liquid, a gas or a combination thereof, such as a foam in a liquid state. Furthermore, different fluids may be dispensed into the wellbore during different cycles of the back and forth motion of the conduit. In cases in which the fluid comprises a gas, the methods include closing the passageway prior to, at the same time or subsequent to the step of introducing the fluid into the wellbore and then continuing to dispense the fluid into the wellbore subsequent to closing the passageway. Storage mediums having program instructions which are executable by a processor for performing any steps of the disclosed methods are also provided.

BRIEF DESCRIPTION OF THE DRAWINGS

Other objects and advantages of the invention will become apparent upon reading the following detailed description and upon reference to the accompanying drawings in which.

Figure 1:
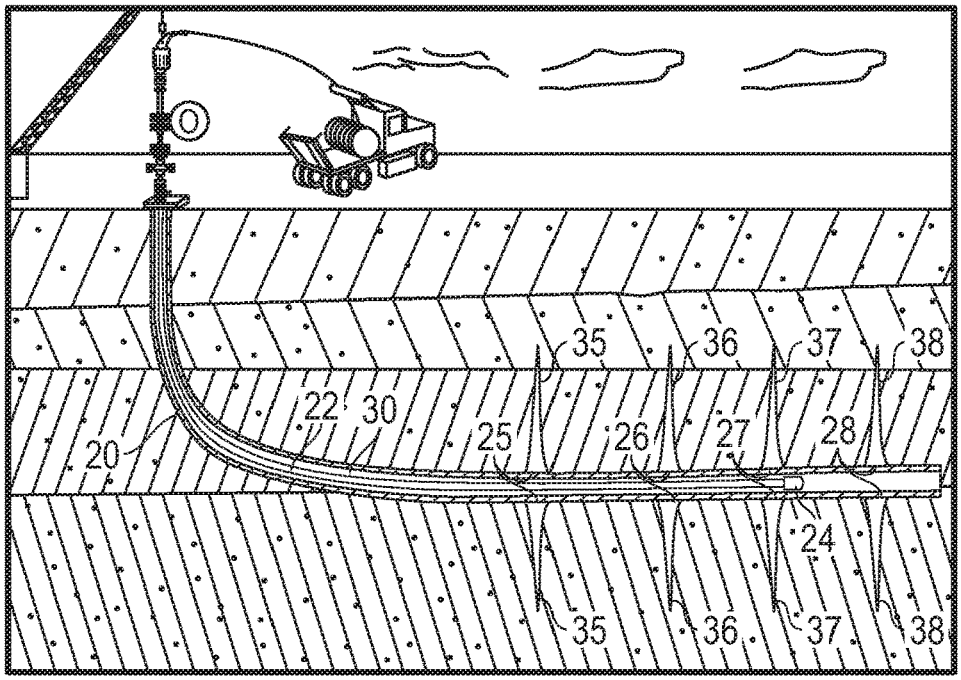
FIG. 1 is a cross-sectional schematic diagram of a wellbore during a circulating cleaning operation performed via a conduit in the wellbore.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF THE PREFERRED EMBODIMENTS

Turning to the drawings, a cleaning operation of wellbore 20 is shown in FIG. 1. In general, the cleaning operation is configured to remove fill, scaling and/or debris from wellbore 20. Configurations to achieve such an objective include circulating one or more cleaning fluids through wellbore 20, specifically by injecting the cleaning fluid/s into the wellbore and pumping the cleaning fluid/s out of the wellbore. Furthermore, the cleaning fluid/s are circulated at a sufficient velocity such that the cleaning fluid/s suspend and carry the fill, scaling and debris out of the wellbore. The cleaning fluid/s may include any fluids known for removing fill, scaling and/or debris from a wellbore, including but not limited to water, brine, solvents, gels, polymers, acids, oils, foams, gases and any mixture thereof. Specific examples of fluids include but are not limited to acetic acid, formic acid, sulfamic acid, citric acid, hydrofluoric acid, fluoroboric acid, hydrochloric acid, mutual solvents, aromatic solvents, and foamed or non-foamed brine solutions. In some cases, the cleaning fluid/s may be injected into the wellbore as well as pumped out of the wellbore at the surface of the wellbore. In other embodiments, a conduit may be extended into the wellbore such as shown in FIG. 1 for the introduction or extraction of the cleaning fluid/s. In particular, the fluid/s may be injected into the wellbore through the interior of conduit 22 and pumped out of the wellbore by way of the annulus around the conduit or vice versa.

In some cases, conduit 22 may include a drill bit 24 (as shown in FIG. 1) and/or one or more nozzles to aid in removing fill, scaling and/or debris from wellbore 22. In particular, a drill bit may particularly aid in removing scaling and/or debris along the interior walls of wellbore 20. In addition, one or more nozzles may aid in introducing the cleaning fluid/s at a sufficient pressure to remove scaling and/or debris along the interior walls of wellbore 20 and/or at a sufficient pressure to suspend particles dislodged from the interior walls such that they may be carried out of the wellbore. In any case, conduit 22 may include any type of pipe or tubing dimensionally configured to and arranged within the wellbore such that passageway 30 exists in the wellbore exterior to the conduit and, in some cases, as an annulus around the conduit, for the removal of the fill, scale and/or debris or for the introduction of the cleaning fluid/s. In general, the fill, scale and/or debris removed from wellbore 20 may include any material used or any byproduct generated while drilling and/or completing the well and/or extracting a resource from the well. Examples of materials and/or byproducts may include, but are not limited to sand, scale, fines, powder, proppant and well rock.

In general, the cleaning operation may be part of a procedure to stimulate the wellbore for greater production in subsequent production runs. In some cases, wellbore 20 may be stimulated after the wellbore has been drilled, cased or completed and before a first production run for extracting a natural resource from the wellbore is conducted. In other embodiments, wellbore 20 may be stimulated after a production run. In such cases, the stimulation process may include the removal of production tubing from the wellbore prior to circulating the cleaning fluid/s through the wellbore. Regardless of its timing, the stimulation process includes ceasing the supply of the cleaning fluid/s into the wellbore when the cleaning operation is complete. In some cases, the amount of fill, scaling and/or debris in the fluid being pumped out of the wellbore during a cleaning operation may be analyzed to determine when to terminate the cleaning operation. In other embodiments, a cleaning operation may be performed for a predetermined amount of time.

In any case, the cleaning operation described in reference to FIG. 1 is generally configured to clean out an interior of a wellbore, but yet limit the amount of cleaning fluid that enters the perforation clusters of the wellbore. Configurations to achieve such an objective include but are not limited to circulating the cleaning fluid/s through the well at a relatively high velocity and/or employing cleaning fluid/s having leak-off control or blocking properties, such as a stiff gel or a foam. As such, fill, scale and/or debris in perforation clusters 25-28 of wellbore 20 and fractures 35-38 in the reservoir extending from the perforation clusters are generally not removed during the cleaning operations described in reference to FIG. 1. To address such a lack of targeted cleaning, the stimulation processes described herein include subsequent processing to clean at least some of perforation clusters 25-28 and fractures 35-38. Details and embodiments of such subsequent processing are described in more detail below in reference to FIGS. 2-10.

Figure 2:
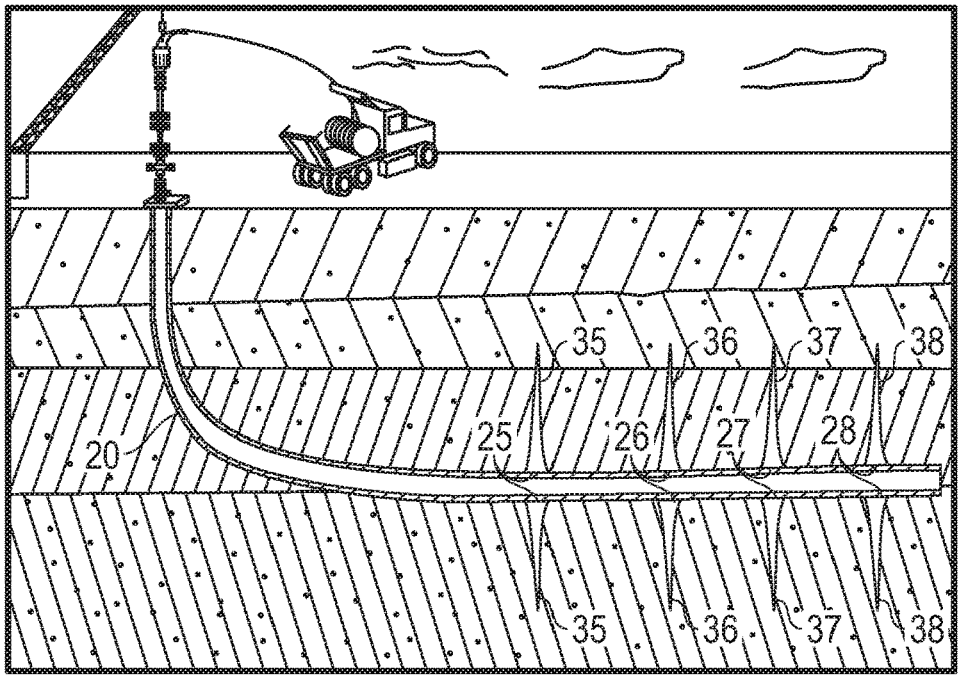
FIG. 2 is a cross-sectional schematic diagram of the wellbore depicted in FIG. 1 subsequent to the termination of the circulating cleaning operation and subsequent to the removal of the conduit therefrom.
Figure 3:
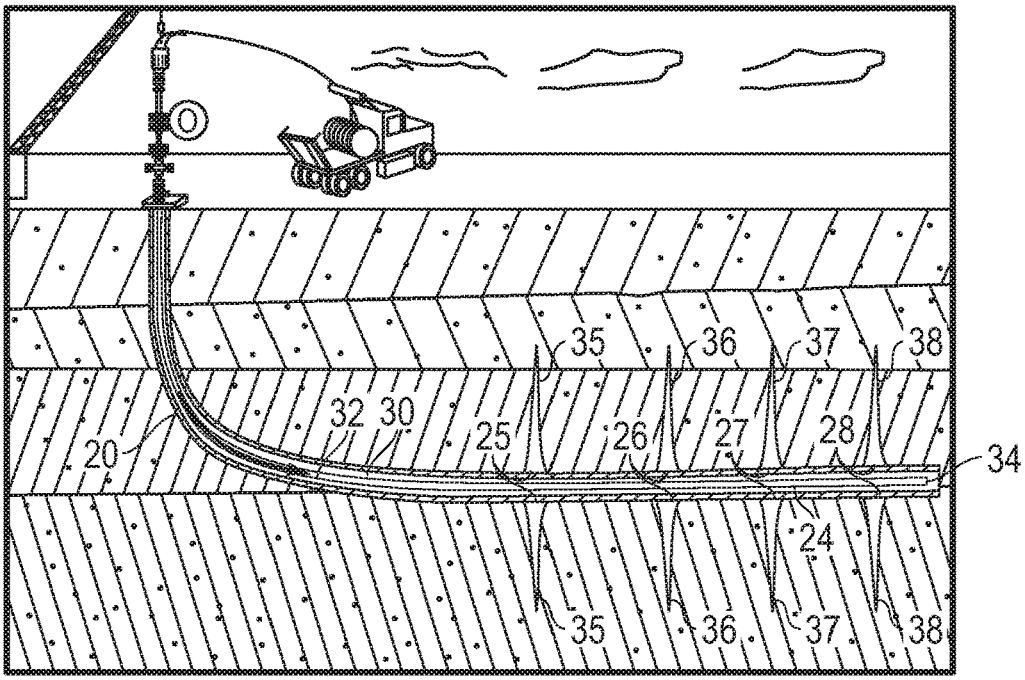
FIG. 3 is a cross-sectional schematic diagram of the wellbore depicted in FIG. 2 subsequent to insertion of a conduit therein to a measured depth past a designated perforation cluster.

Subsequent to ceasing the supply of the cleaning fluid/s into wellbore 20 as described in reference to FIG. 1, conduit 22 may, in some embodiments, be pulled out of the wellbore as shown in FIG. 2 and a different conduit 32 may be introduced into wellbore 20 as shown in FIG. 3. In other cases, conduit 22 may be pulled out of wellbore 20 and then run back into wellbore 20 for the processes described in reference to FIGS. 3-10. In either case, such a sequence of process steps may be particularly applicable when conduit 22 includes a drill bit at its forward end as shown and described in reference to FIG. 1 such that the drill bit may be taken out of wellbore 20 prior to performing the processes described in reference to FIGS. 3-10. In particular, conduit 32 may not, in some cases, include a drill bit or drill bit 24 may be removed from conduit 22 prior to running the conduit back into the wellbore. In general, it may be advantageous to introduce the fluids described in reference to FIGS. 3-10 into wellbore 20 without a drill bit at the end of conduit 22 or 32 to minimize turbulence of the fluids near perforation clusters 25-28. More specifically, introducing fluids into wellbore 20 using a conduit that does not have nozzles at its forward end may aid in introducing the fluids discussed in reference to FIGS. 3-10 at substantially lower pressure than if they were introduced through nozzles, such as is done with the one or more cleaning fluids for the process described in reference to FIG. 1. As a result, the fluids introduced into wellbore 20 for the processes described in reference to FIGS. 3-10 may be less likely to be mixed together. Consequently, the fluids introduced into wellbore 20 for the processes described in reference to FIGS. 3-10 may distinctly and successively occupy the region of the wellbore near perforation clusters 25-28.

In yet other embodiments, conduit 22 may not be pulled out of wellbore 20 subsequent to ceasing the supply of the cleaning fluid/s into wellbore 20. In other words, the process described in reference to FIG. 3 may, in some cases, be conducted after the cleaning operation described in reference to FIG. 1 has ended without performing the process described in reference to FIG. 2. In such cases, drill bit may be retained on conduit 22 for the processes discussed in reference to FIGS. 3-10. In other embodiments, however, conduit 22 may not include a drill bit at its forward end for the cleaning operation and, thus, conduit 22 may not include a drill bit at its forward end for the processes discussed in reference to FIGS. 3-10. In yet other cases, conduit 32 may be introduced into wellbore 20 after conduit 22 is removed and conduit 32 may include a drill bit with nozzles. It is noted that although processes discussed in reference to FIGS. 3-10 are described using conduit 32, the stimulation processes described herein need not be so limited. In particular, it is noted that the movement of conduit 32 described in reference to FIGS. 3-10 is dually applicable to movement of conduit 22 in embodiments in which conduit 22 is reintroduced into wellbore 20 or in embodiments in which conduit 22 is not removed from wellbore 20 subsequent to the cleaning operations described in reference to FIG. 1. As such, the processes disclosed herein need not be limited to the depiction of the drawings.

In general, conduit 32 is configured to dispense fluid at its forward end. In addition, conduit 32 is configured to prevent back flow of fluid through a majority portion of the conduit such as via a check valve. Moreover, as with conduit 22, conduit 32 is dimensionally configured and arranged in wellbore 20 such that passageway 30 exists in the wellbore exterior to the conduit and, in some cases, as an annulus around the conduit as shown in FIG. 3. Passageway 30 is denoted as being open by the reference letter "O" at the surface pump of wellbore 20 in FIGS. 1 and 3-6 for the processes described in reference thereto. In addition, passageway 30 is denoted as being closed by the reference letter "X" at the surface pump of wellbore 20 in FIGS. 7-10 for the processes described in reference thereto. The reference of passageway 30 being closed refers to the passageway being shut to impede atmospheric exposure to passageway 30. Conversely, reference of passageway 30 being open refers to the passageway being exposed to the atmosphere. It is noted that the configuration of the setup at wellbore 20 to have passageway 30 shut or open may be of various forms as known in the art. For example, one setup at wellbore 20 may be to have piping extending from passageway 30 that leads to a tank or containment pit such that fluid pumped out of passageway 30 may be managed. In such embodiments, a choke manifold is arranged within the piping and is used to manipulate exposure of passageway 30 to the atmosphere.

As shown in FIG. 3, conduit 32 may be extended until a forward end of the conduit reaches a measured depth in the wellbore that is deeper than a designated perforation cluster of the wellbore. More specifically, FIG. 3 shows conduit 32 extending to measured depth 34 past perforation cluster 28. Although perforation cluster 28 has been designated for the illustration of the process in reference to FIG. 3, any other perforation cluster in wellbore 20 may be designated for reference of the extension of conduit 32. Furthermore, the measured depth to which conduit 32 is extended in reference to FIG. 3 may be designated or not. In either case, the measured depth to which conduit 32 is extended in reference to FIG. 3 may be any distance past the designated perforation cluster. An example distance range may be between approximately 25 feet and approximately 75 feet, but larger and smaller distances may be considered.

Figure 4:
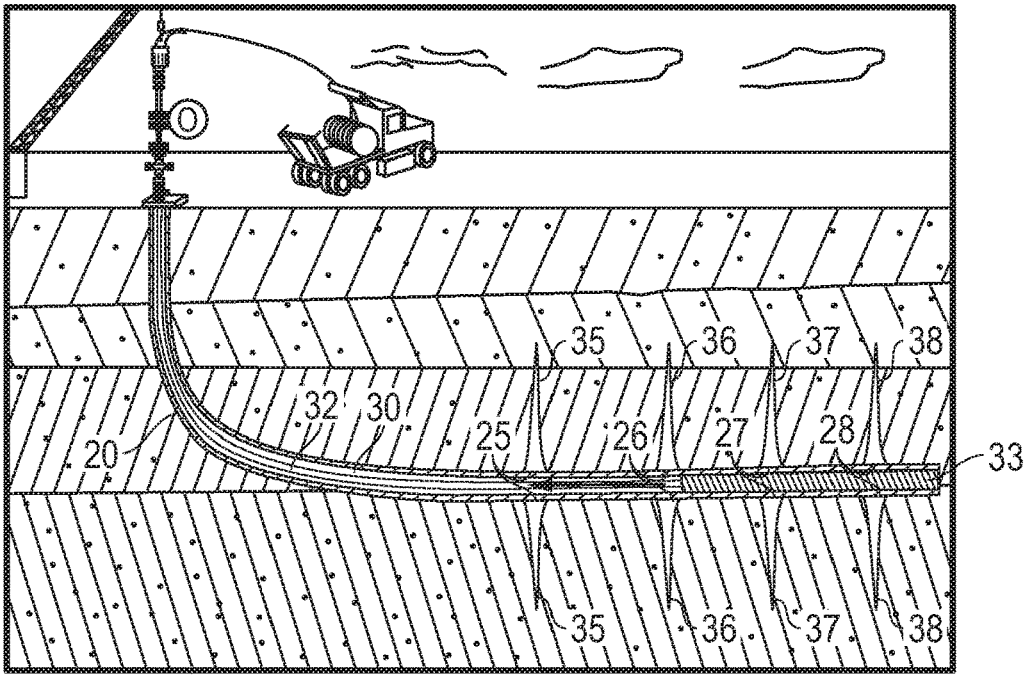
FIG. 4 is a cross-sectional schematic diagram of the wellbore depicted in FIG. 3 subsequent to the introduction of a fluid through the conduit and movement of the conduit toward a shallower measured depth.

In any case, subsequent to conduit 32 passing the designated perforation cluster, such as designated perforation cluster 28, fluid 33 is introduced into wellbore 20 through the forward end of conduit 32 and the conduit is retracted as shown in FIG. 4. More specifically, fluid 33 may be introduced into wellbore 20 any time subsequent to conduit 32 passing the designated perforation cluster, such as designated perforation cluster 28, for the extension process described in reference to FIG. 3, but before conduit 32 passes the designated perforation cluster during the retraction of the conduit described in reference to FIG. 4. The term "introduce", as used herein, refers to beginning the presentation of something into use or operation. Thus, the phrase of introducing a fluid into a wellbore, as used herein, refers to beginning the dispensement of the fluid in the wellbore. The term "forward end" as used herein in relation to a conduit disposed in a wellbore refers to a portion of a conduit within approximately 50 feet of the end of the conduit first introduced into a wellbore.

In any case, fluid 33 may include any fluid known for removing fill, scaling and/or debris from a wellbore, including but not limited to water, brine, solvents, gels, polymers, acids, oils, foams, gases and any mixture thereof. Specific examples of fluids include but are not limited to acetic acid, formic acid, sulfamic acid, citric acid, hydrofluoric acid, fluoroboric acid, hydrochloric acid, mutual solvents, aromatic solvents, and foamed or non-foamed brine solutions. In some cases, it may be advantageous for fluid 33 to include a solvent, particularly a solvent known for dissolving fill, scaling and/or debris of a wellbore. In particular, as described in more detail below in reference to FIGS. 7-10, fluid 33 will be subsequently pushed into perforation clusters 25-28 and fractures 35-38 and, thus, it may be advantageous to have fluid 33 have a composition which is capable of dissolving fill, scaling and/or debris that may be lodged in or lining perforation clusters 25-28 and fractures 35-38.

Figure 5:
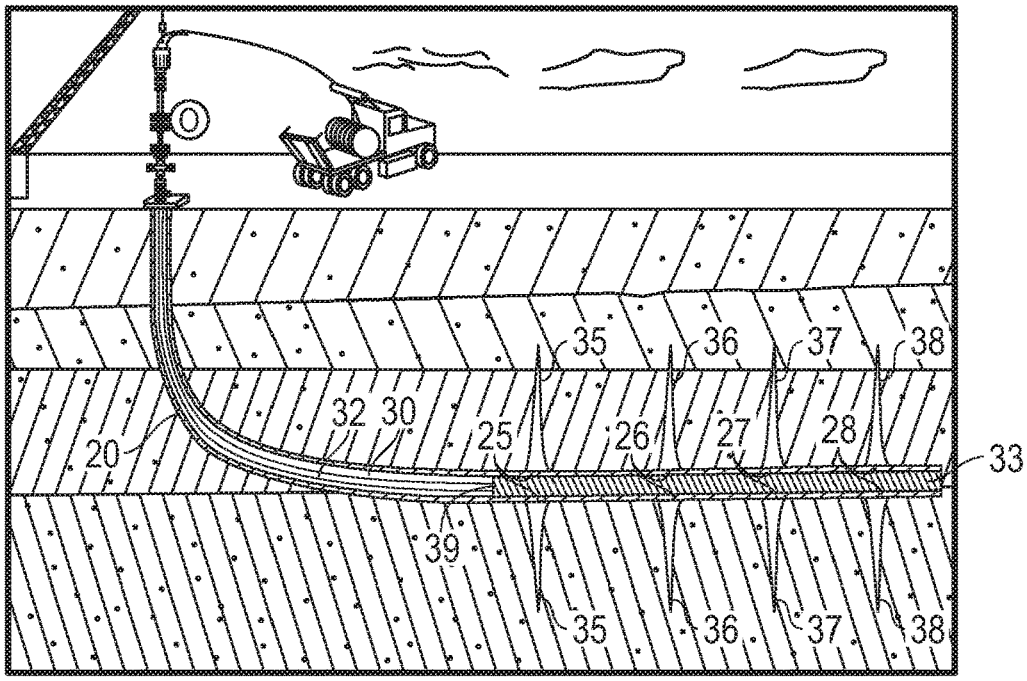
FIG. 5 is a cross-sectional schematic diagram of the wellbore depicted in FIG. 4 subsequent to the conduit stopping at a measured depth shallower than a first perforation cluster of the wellbore.

In general, conduit 32 may be retracted until a forward end of the conduit reaches a measured depth in the wellbore that is shallower than a designated perforation cluster of the wellbore. For instance, FIG. 5 shows the retraction of conduit 32 may extend until a forward end of the conduit reaches measured depth 39 in wellbore 20 that is shallower than designated perforation cluster 25. The measured depth to which conduit 32 is retracted in reference to FIG. 5 may be any distance past the designated perforation cluster. An example distance range may be between approximately 25 feet and approximately 75 feet, but larger and smaller distances may be considered. Furthermore, fluid 33 may be dispensed into wellbore 20 during part of or during the entire retraction of conduit 32, preferably to fill the portion of wellbore 20 vacated by the retraction of conduit 32.

Although perforation cluster 25 has been designated for the illustration of the retraction process in reference to FIG. 5, any other perforation cluster in wellbore 20 may be designated for reference of the retraction of conduit 32, including perforation cluster 28. In particular, it may be advantageous, in some embodiments, to restrict some of the stimulation processes conducted in reference to FIGS. 3-10 to clean out a subset of less than all of perforation clusters 25-28 and fractures 35-38. As such, in some embodiments, the perforation cluster designated for the extension of conduit 32 described in reference to FIG. 3 may, in some embodiments, may be a perforation cluster that is shallower than the deepest perforation cluster in the wellbore. In addition or alternatively, the perforation cluster designated for the retraction of conduit 32 described in reference to FIG. 5 may, in some cases, may be a perforation cluster that is deeper than the shallowest perforation cluster in the wellbore. In some embodiments, some of the stimulation processes conducted in reference to FIGS. 3-10 may be targeted to a single perforation cluster and, thus, the perforation cluster designated in reference to the extension of conduit 32 described in reference to FIG. 3 may, in some cases, be the same perforation cluster designated in reference to the retraction of conduit 32 described in reference to FIG. 5.

Figure 6:
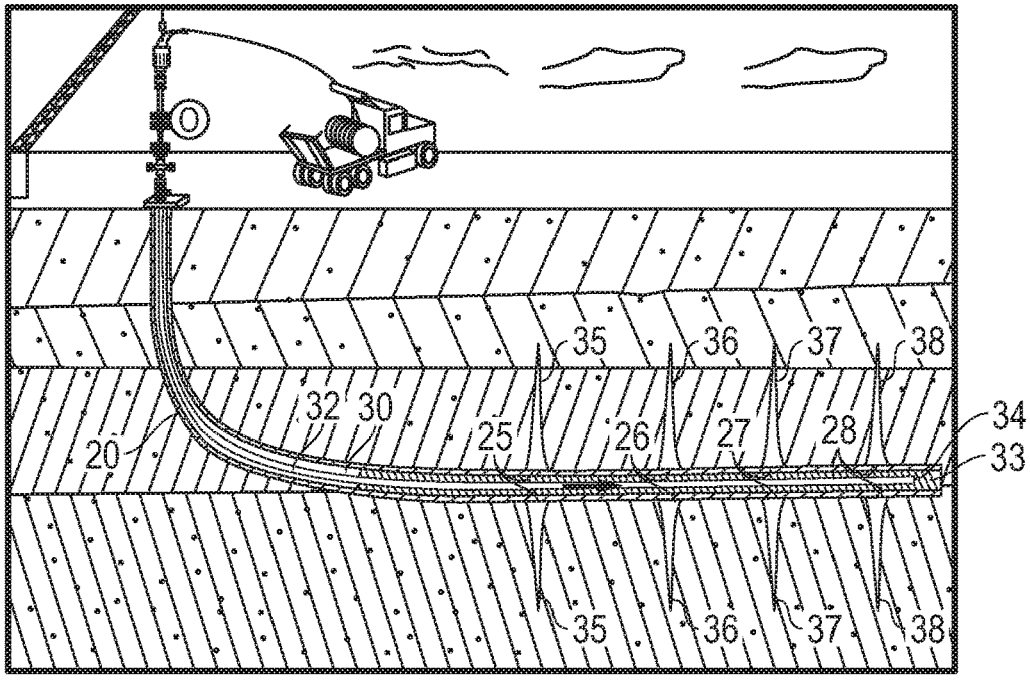
FIG. 6 is a cross-sectional schematic diagram of the wellbore depicted in FIG. 5 subsequent to the conduit moving back toward and past the designated perforation cluster.

Regardless of the measured depth conduit 32 is retracted to, conduit 32 may be subsequently moved back toward measured depth 34 as shown in FIG. 6. In some cases, the movement of conduit 32 back toward measured depth 34 may involve moving conduit 32 past perforation cluster 28, particularly to a measured depth deeper than perforation cluster 28 as shown in FIG. 6. In such cases, the measured depth to which conduit 32 may be moved may be shallower, deeper or the same as measured depth 34. In general, the movement of conduit 32 past perforation cluster 28 may be advantageous such that a subsequent fluid may be introduced into wellbore 20 and fill the portion of the wellbore comprising perforation cluster 28, such as described in more detail below in reference to FIG. 7. In some cases, however, the movement of conduit 32 back toward measured depth 34 may involve moving conduit 32 to a measured depth shallower than perforation cluster 28.

In any case, fluid 33 may be dispensed into wellbore 20 during part of or during the entire movement of conduit 32 back toward measured depth 34. Such further dispensement of fluid 33 relative to the dispensement of fluid 33 during the retraction of conduit 32 may be advantageous to insure a suitable amount of fluid 33 is dispensed into wellbore 20 for subsequent processing, particularly for processes which involve pushing fluid 33 into fractures 35-38 as described in more detail below in reference to FIGS. 7-10. In some embodiments, the dispensement of fluid 33 during the movement of conduit 32 back toward measured depth 34 may be terminated after the forward end of conduit 32 passes a designated perforation cluster. The designated perforation cluster may be any of perforation clusters 25-28 and may or may not be the same as the perforation cluster designated for conduit 32 to move past when initially moving conduit 32 toward measured depth 34 for the process described in reference to FIG. 3. In some cases, the dispensement of fluid 33 may be terminated after the forward end of conduit 32 passes a designated perforation cluster but before conduit 32 is stopped. In other embodiments, the dispensement of fluid 33 may be continued after conduit 32 is stopped. In yet other cases, fluid 33 may not be dispensed while conduit 32 is moved back toward measured depth 34. In particular, if a suitable amount of fluid 33 is dispensed into wellbore 20 during the processes described in reference to FIGS. 4 and 5 to fill the portion of wellbore 20 vacated by the retraction of conduit 32, movement of conduit 32 back toward measured depth 34 may simply serve to displace some of fluid 33 within the portion of wellbore 20 comprising perforation clusters 25-28 without adding additional amounts of fluid 33 thereto. In any case, the movement of conduit 32 back toward measured depth 34 will push fluid 33 farther up wellbore 36 as shown in FIG. 6.

As denoted by the reference letter "O" at the surface pump of wellbore 20 in FIGS. 4-6, passageway 30 is open for the processes described in reference thereto. In general, it will be advantageous to pump fluid out of passageway 30 during one or more of the processes described in reference to FIGS. 4-6 (i.e., during one or more of the steps of dispensing fluid 33 into wellbore 20, retracting conduit 32 and moving conduit 32 back toward measured depth 34 and, in particular embodiments, at least during the processes described in reference to FIGS. 4 and 5). In particular, pumping fluid out of passageway 30 will help reduce the amount of fluid previously residing in wellbore 20 (i.e., previous to the introduction of fluid 33 into wellbore 20) from being mixed with fluid 33 and potentially being introduced into perforation clusters 25-28 and fractures 35-38 during subsequent processing. More specifically, fluid residing in wellbore 20 prior to the introduction of fluid 33 into wellbore 20 may include some residual fill, scale and/or debris from the previous cleaning operation conducted in reference to FIG. 1, and thus, it may be advantageous to minimize the mixture of fluid 33 with such residual fluid.

In some embodiments, the retraction of conduit 32, the dispensement of fluid 33 into wellbore 20 and the pump out of fluid out of wellbore 20 performed in reference to FIGS. 4 and 5 may be conducted at relative rates such that fluid 33 substantially fills the portion of wellbore 20 vacated by the movement of conduit 32 as the conduit is retracted and reaches measured depth 39 (i.e., without substantial mixture with other fluids previously residing in wellbore 20). In particular, it may be advantageous to retract conduit 32, dispense fluid 33 and pump fluid out of wellbore 20 at relative rates such that fluid 33 substantially displaces any fluid previously residing in the portion of wellbore 20 comprising perforation clusters 25-28. With such an objective in mind, the retraction of conduit 32 in reference to FIGS. 4 and 5 may, in some cases, be conducted at a rate such that a rate of volumetric displacement of conduit 32 within the wellbore 20 and the rate fluid 33 dispensed into the wellbore are both within 20% of the rate at which fluid is pumped out at the surface of wellbore while the conduit is being retracted. In particular, if conduit 32 is retracted too fast and/or if fluid 33 is dispensed too slow relative to the rate fluid is pumped out of wellbore 20, fluid 33 may be mixed with fluids previously residing in wellbore 20. Furthermore, if fluid is pumped out too fast relative to the rate fluid is dispensed into wellbore 20, some of fluid 33 may be unnecessarily pumped up into the vertical portion of the wellbore. In some of such cases, some of fluid 33 may be pumped out of wellbore 20, unnecessarily wasting fluid 33.

Similarly, while conduit 32 is moved back toward measured depth 34 in reference to FIG. 6, the dispensement of fluid 33 into wellbore 20 and the pump out of fluid out of wellbore 20 may be conducted at relative rates such that fluid 33 is not pumped up into a substantial portion of the vertical portion of the wellbore or pumped out of the wellbore. In particular, it may be advantageous to dispense fluid 33 and pump fluid out of wellbore 20 at rates within 20% of each other while conduit 32 is being moved back toward measured depth 34.

Figure 7:
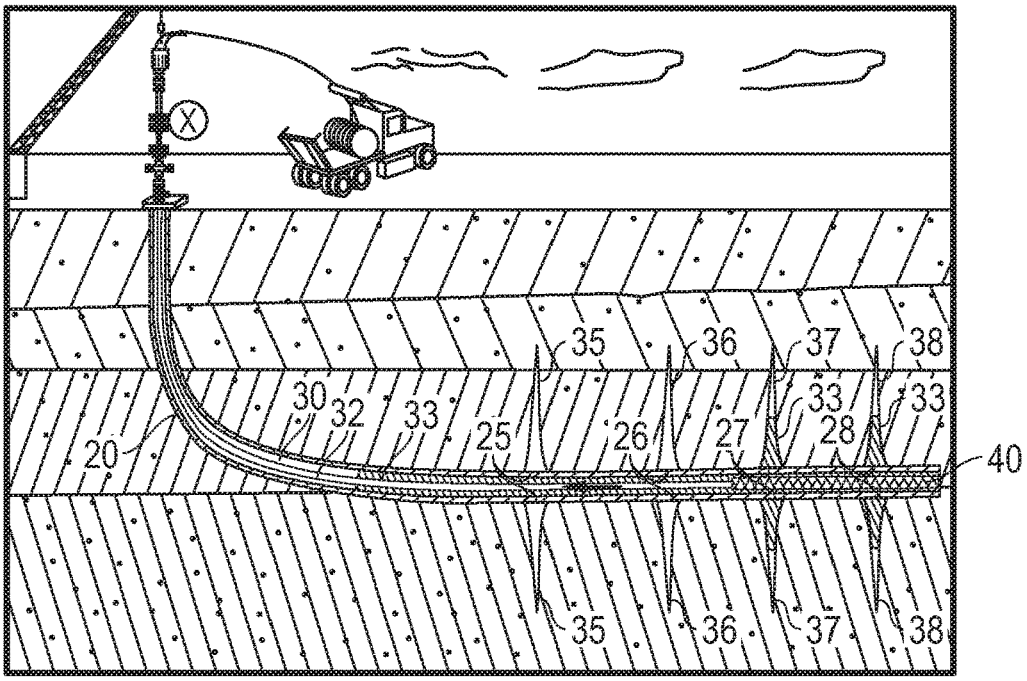
FIG. 7 is a cross-sectional schematic diagram of the wellbore depicted in FIG. 6 subsequent to introduction of a different fluid through the conduit and movement of the conduit back toward a shallower measured depth.

In any case, subsequent to conduit 32 moving back toward measured depth 34, fluid 40 may be introduced into wellbore 20 through the forward end of conduit 32 and the conduit may be retracted as shown in FIG. 7. In general, fluid 40 may be introduced into wellbore 20 any time subsequent to conduit 32 passing the designated perforation cluster for the process of moving conduit 32 back toward measured depth 34 as described in reference to FIG. 6, but before conduit 32 passes the same designated perforation cluster during the retraction of the conduit described in reference to FIG. 7. Furthermore, fluid 40 may generally include any fluid known for removing fill, scaling and/or debris from a wellbore, including but not limited to water, brine, gels, polymers, acids, oils, foams, gases and any mixture thereof. Specific examples of fluids include but are not limited to acetic acid, formic acid, sulfamic acid, citric acid, hydrofluoric acid, fluoroboric acid, hydrochloric acid, mutual solvents, aromatic solvents, and foamed or non-foamed brine solutions. In some cases, fluid 40 may be a liquid. In other cases, fluid 40 may be a gas or a foam in liquid state. As used herein, "foam in a liquid state" refers a colloidal suspension of a gas in a liquid. The gas and/or the foam in a liquid state used for fluid 40 may include any gas or foam known for use in wellbores. An example of a foam in a liquid state that may be used for fluid 40 includes but is not limited to foamed ammonium chloride. Furthermore, the percentage quality of the foam may vary depending on the design specifications for the process. For example, the range of percentage quality of foam used for fluid 40 may vary between 30% and 90%.

Figure 8:
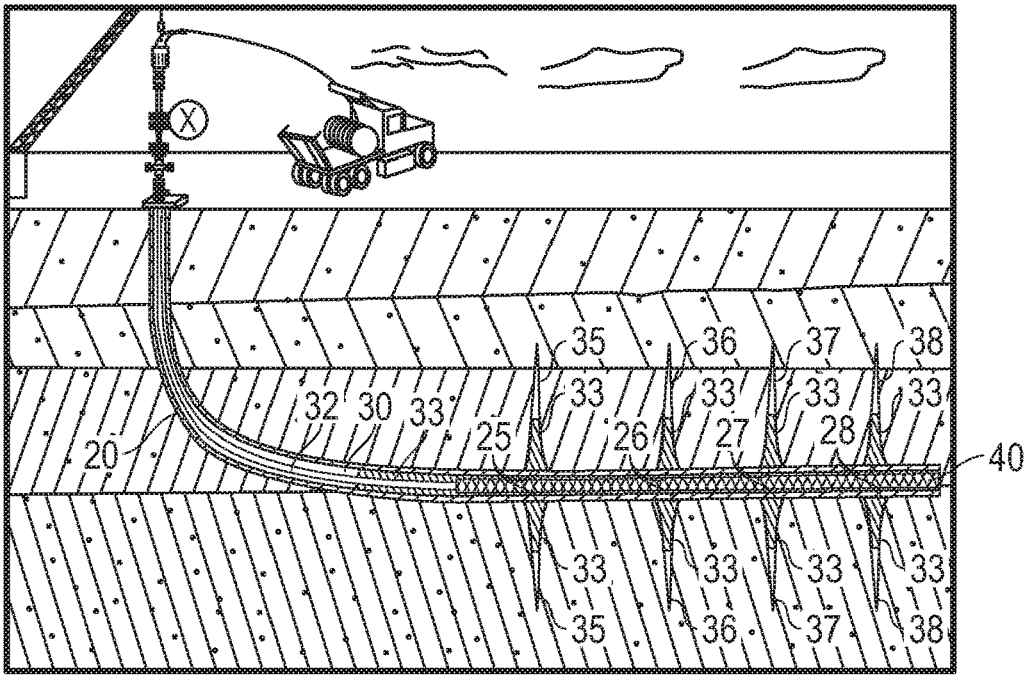
FIG. 8 is a cross-sectional schematic diagram of the wellbore depicted in FIG. 7 subsequent to the conduit stopping at a measured depth shallower than the first perforation cluster of the wellbore.

In any case, as denoted by the reference letter "X" at the surface pump of wellbore 20 in FIG. 7, passageway 30 is closed for at least a majority of the time the processes described in reference thereto are conducted. In particular, passageway 30 is closed for at least a majority of the time conduit 32 is retracted and a majority of the time fluid 40 is dispensed into wellbore 20. In general, passageway 30 may be closed any time subsequent to conduit 32 passing the designated perforation cluster for the process of moving conduit 32 back toward measured depth 34 described in reference to FIG. 6, but before conduit 32 passes the same designated perforation cluster during the retraction of the conduit described in reference to FIG. 7. As such, passageway 30 may be closed prior to, during or subsequent to fluid 40 being introduced into wellbore 20. In addition, passageway 30 may be closed prior to or during the retraction of conduit 32 described in reference to FIG. 7. In any case, closing passageway 30 will impede atmospheric exposure to wellbore 20 and, in turn, will induce hydrostatic pressure in the passageway that aids in displacing fluid 33 into fractures 35-38 during the retraction of conduit 32 as shown in FIGS. 7 and 8. More specifically, closing passageway 30 will cause the fluid therein to apply a downward hydrostatic force that will counteract the dispensement of fluid 40 during the retraction of conduit 32, which will in turn cause fluid 33 residing in the portion of wellbore 20 comprising perforation clusters 25-28 to be displaced into fractures 35-38.

As shown in FIG. 8, conduit 32 may be retracted until a forward end of the conduit reaches a measured depth in the wellbore that is shallower than a designated perforation cluster of the wellbore. In some case, the designated perforation cluster may be the same perforation cluster designated for the retraction of conduit 32 described in FIG. 5 and, thus, the retraction of conduit 32 may continue until a forward end of the conduit reaches measured depth 39 as shown in FIG. 8. Any other perforation cluster, however, may be designated for reference of the retraction of conduit 32 in reference to FIG. 8 as similarly discussed for the retraction process described in reference to FIG. 5. In any case, the measured depth to which conduit 32 is retracted in reference to FIG. 8 may be any distance past the designated perforation cluster. An example distance range may be between approximately 25 feet and approximately 75 feet, but larger and smaller distances may be considered.

As noted above, closing passageway 30 prior to or during the processes described in reference to FIG. 7 will cause the fluid in the vertical section of the wellbore to apply a downward hydrostatic force that will counteract the dispensement of fluid 40 during the retraction of conduit 32, which will in turn cause fluid 33 residing in the portion of wellbore 20 comprising perforation clusters 25-28 to be displaced into fractures 35-38. In such a context, the flow rate of fluid 40 is preferably set at a rate to sufficiently counteract the downward hydrostatic force such that fluid residing in the vertical portion of wellbore 20 does not enter into portion of the wellbore comprising perforation clusters 25-28 and/or mix with fluid 33 or fluid 40. A further effect from such a flow rate of fluid 40 is that the dispensement of fluid 40 may substantially push fluid 33 into perforation clusters 25-28 and fractures 35-38 rather than diffuse fluid 40 into fluid 33. As a result, the properties of fluid 33 may remain substantially the same when displaced into perforation clusters 25-28 and fractures 35-38 and, thus, the effect of fluid 33 to dissolve and/or remove fill, scale and/or debris from perforation clusters 25-28 and fractures 35-38 may be retained.

In some embodiments, the dispensement of fluid 40 into wellbore 20 may be conducted at rate relative to the retraction rate of conduit 32 during the processes performed in reference to FIGS. 7 and 8 such that fluid 40 displaces at least a third of fluid 33 residing in the portion of wellbore 20 vacated by the movement of conduit 32 into perforation clusters 25-28 and fractures 35-38. In particular, it may be advantageous to retract conduit 32 and dispense fluid 40 at relative rates such that fluid 33 substantially displaces at least a third and, sometimes approximately half or all, of the fluid previously residing in the portion of wellbore 20 comprising perforation clusters 25-28 into perforation clusters 25-28 and fractures 35-38. With such an objective in mind, the retraction of conduit 32 in reference to FIGS. 7 and 8 may, in some cases, be conducted at a rate such that a rate of volumetric displacement of conduit 32 within the wellbore 20 is less than 200% of the rate fluid 40 is dispensed into the wellbore. In other words, the retraction of conduit 32 in reference to FIGS. 7 and 8 may, in some cases, be conducted at a rate such that a rate of volumetric displacement of conduit 32 within the wellbore 20 is less than twice the rate fluid 40 is dispensed into the wellbore.

In particular, if conduit 32 is retracted too fast relative to the rate at which fluid 40 is introduced into wellbore 20, fluid residing in the portion of wellbore 20 shallower than perforation cluster 25 may be introduced into fluid 33 and/or fluid 40. Such an introduction of fluid into fluid 33 and/or fluid 40 may contaminate fluid 33 and/or fluid 40 with residual fill, scale or debris from the portion of wellbore 20 shallower than perforation cluster 25. In addition or alternatively, an introduction of fluid from portions of wellbore 20 shallower than perforation cluster 25 into fluid 33 and/or fluid 40 may potentially alter the properties of fluid 33 and/or fluid 40, which may possibly reduce their functionality to remove fill, scale and/or debris from perforation clusters 25-28 and fractures 35-38 when fluid 33 and/or fluid 40 are subsequently displaced therein.

Figure 9:
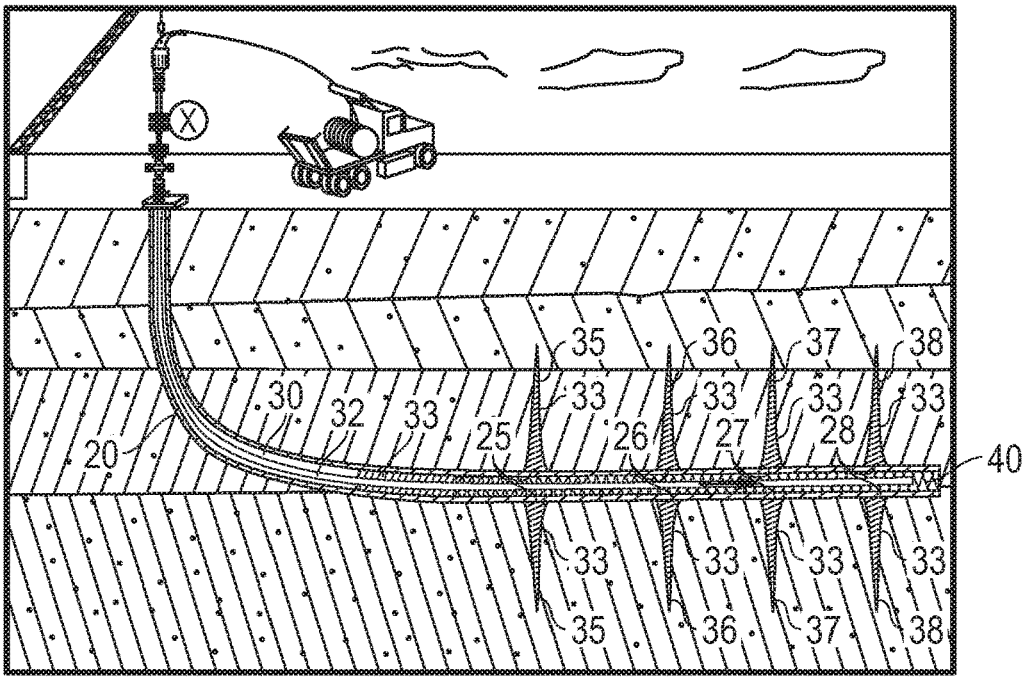
FIG. 9 is a cross-sectional schematic diagram of the wellbore depicted in FIG. 8 subsequent to the conduit moving back toward and past the designated perforation cluster.

In any case, subsequent to conduit 32 reaching a measured depth past a designated perforation cluster, such as measured depth 39 as shown in FIG. 8, conduit 32 may be moved back toward measured depth 34 as shown in FIG. 9. Similar to the process described in reference to FIG. 6, the movement of conduit 32 back toward measured depth 34 in reference to FIG. 9 may involve moving conduit 32 past perforation cluster 28, particularly to a measured depth deeper than perforation cluster 28. In such cases, the measured depth to which conduit 32 may be moved to and stopped at may be shallower, deeper or the same as measured depth 34. In general, the movement of conduit 32 past perforation cluster 28 may be advantageous such that a subsequent fluid may be introduced into wellbore 20 and fill the portion of the wellbore comprising perforation cluster 28. In other embodiments, however, the movement of conduit 32 back toward measured depth 34 in reference to FIG. 9 may involve moving conduit 32 to and stopping conduit 32 at a measured depth shallower than perforation cluster 28. In any case, the movement of conduit 32 toward measured depth 34 may involve displacing the remaining portion of fluid 33 in the portion of wellbore 20 comprising perforation clusters 25-28 into perforation clusters 25-28 and fractures 35-38 as shown in FIG. 9. Although not shown, the movement of conduit 32 toward measured depth 34 in reference to FIG. 9 may, in some cases, involve displacing some of fluid 40 into perforation clusters 25-28 and fractures 35-38.

In any case, fluid 40 may be dispensed into wellbore 20 during part of or during the entire movement of conduit 32 back toward measured depth 34. Such further dispensement of fluid 40 relative to the dispensement of fluid 40 during the retraction of conduit 32 may be advantageous to insure a suitable amount of fluid 40 is dispensed into wellbore 20 for subsequent processing, particularly for processes which involve pushing fluid 40 into fractures 35-38 as described in more detail below. In some embodiments, the dispensement of fluid 40 during the movement of conduit 32 back toward depth 34 may be terminated after the forward end of conduit 32 passes a designated perforation cluster. The designated perforation cluster may be any of perforation clusters 25-28 and may or may not be the same as the perforation cluster designated for conduit 32 to move past when moving toward measured depth 34 for the process described in reference to FIG. 6. In some cases, the dispensement of fluid 40 may be terminated after the forward end of conduit 32 passes a designated perforation cluster but before conduit 32 is stopped. In other embodiments, the dispensement of fluid 40 may be continued after conduit 32 is stopped. In yet other cases, fluid 40 may not be dispensed while conduit 32 is moved back toward measured depth 34. In particular, if a suitable amount of fluid 40 is dispensed into wellbore 20 during the processes described in reference to FIGS. 7 and 8, movement of conduit 32 back toward measured depth 34 may simply serve to displace some of fluid 33 and possibly some of fluid 40 into perforation clusters 25-28 and fractures 35-38.

In general, the processes described in reference to 7-9 may be repeated with one or more fluids subsequent to the process described in reference to FIG. 9. In particular, one or more fluids may be respectively dispensed into wellbore 20 while moving conduit 32 back and forth, particularly along the portion of wellbore 20 comprising perforation clusters 25-28. The one or more fluids used during subsequent processing may be any fluid known for removing fill, scaling and/or debris from a wellbore, including but not limited to water, brine, gels, polymers, acids, oils, foams, gases and any mixture thereof. Specific examples of fluids include but are not limited to acetic acid, formic acid, sulfamic acid, citric acid, hydrofluoric acid, fluoroboric acid, hydrochloric acid, mutual solvents, aromatic solvents, and foamed or non-foamed brine solutions. In some cases, the one or more fluids used in subsequent processing may include the fluid used for fluid 33 described in reference to FIGS. 4-6 and/or may include the fluid used for fluid 40 described in reference to FIGS. 7-9. In addition or alternatively, different fluids may be used for subsequent processing. In some embodiments, the stimulation methods described herein may involve dispensing a liquid in one cycle of back and forth motion of conduit 32 and dispensing a gas or foam in a liquid state in a different cycle of back and forth motion of conduit 32. In such cases, the dispensement of the liquid may be prior to or subsequent to the dispensement of the gas or foam. In some embodiments, the stimulation methods described herein may include repeatedly alternating the dispensement of two different fluids in different cycles of back and forth motion of conduit 32.

Figure 10:
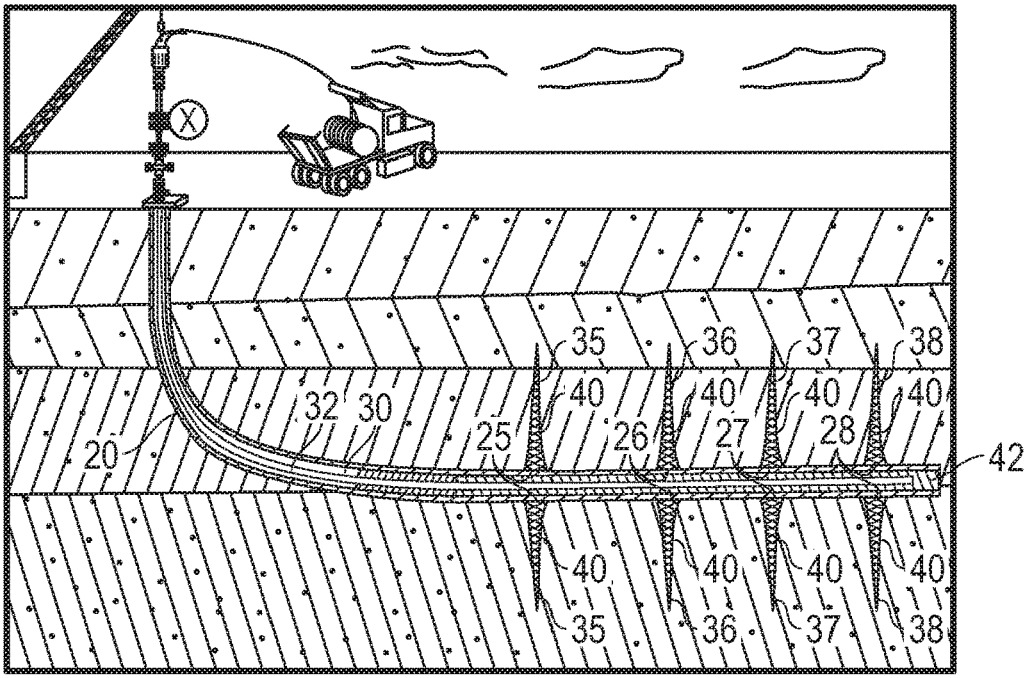
FIG. 10 is a cross-sectional schematic diagram of the wellbore depicted in FIG. 9 subsequent to dispensing another different fluid through the conduit and moving the conduit back and forth between the measured depths.

In any case, the subsequent processing will cause fluid previously introduced into the portion of wellbore 20 comprising perforation clusters 25-28 to be displaced into perforation clusters 25-28 and fractures 35-38. For instance, as shown in FIG. 10, dispensing fluid 42 into wellbore 20 while moving conduit 32 back and forth subsequent to the process described in reference to FIG. 9 will cause fluid 40 to be displaced into perforation clusters 25-28 and fractures 35-38. To affect such displacement, the dispensement of additional fluids into wellbore 20 may be at a rate relative to the retraction rate of conduit 32 as similarly described for the processes described in reference to FIGS. 7 and 8. In particular, a rate of volumetric displacement of conduit 32 within the wellbore 20 during stimulation processes conducted after the dispensement of fluid 40 may be less than 200% of the rates of the one or more fluids dispensed into the wellbore. In other words, the retraction of conduit 32 in reference to FIG. 10 may, in some cases, be conducted at a rate such that a rate of volumetric displacement of conduit 32 within the wellbore 20 is less than twice the rate a fluid is dispensed into the wellbore during the retraction of conduit 32.

The number of cycles conduit 32 is moved back and forth with a fluid dispensed into the wellbore during at least a portion of such movement may be any number. Regardless of the number of back and forth cycles of conduit 32, the stimulation process may generally terminate with pulling conduit 32 out of wellbore 20 and opening passageway 30. In some cases, the stimulation process described herein may open passageway 30 after the designated back and forth cycles of conduit 32 are performed and then a rinsing fluid may be circulated through wellbore 20 via conduit 32. The rinsing fluid may include but is not limited to water, brine, gels, polymers, acids, oils, foams, gases and any mixture thereof. After a preset amount of time or upon particular analysis of the rinsing fluid pumped out of wellbore 20, conduit 32 may be pulled out of wellbore 20. In other cases, however, the stimulation processes described herein may not include a rinsing circulation process.

In general, the processes described herein may be performed manually or may be automated. In particular, any of all of the movement of conduits 22 and 32, the dispensement (i.e., including the introduction and termination) of fluids into wellbore 20, as well as the closing of passageway 30, may be manipulated and controlled manually and/or may be automated. In cases in which at least some of the processes are automated, the automated processes may be facilitated by circuitry or by the use of program instructions stored in a storage medium of an apparatus or system used in conjunction with the stimulation process. In general, the term "storage medium", as used herein, may refer to any electronic medium configured to hold one or more set of program instructions, such as but not limited to a read-only memory, a random access memory, a magnetic or optical disk, or magnetic tape. The term "program instructions" may generally refer to commands within a program which are configured to perform a particular function, such as but not limited to receiving input, recording receipts of signals, sending output signals and determining whether to allow an apparatus to start an operation. Program instructions may be implemented in any of various ways, including procedure-based techniques, component-based techniques, and/or object-oriented techniques, among others. For example, the program instructions may be implemented using ActiveX controls, C++ objects, JavaBeans, Microsoft Foundation Classes ("MFC"), or other technologies or methodologies, as desired. Program instructions implementing the processes described herein may be transmitted over on a carrier medium such as a wire, cable, or wireless transmission link.

It will be appreciated to those skilled in the art having the benefit of this disclosure that this invention is believed to provide methods and storage mediums with processor-executable program instructions for cleaning perforation clusters and reservoir fractures. Further modifications and alternative embodiments of various aspects of the invention will be apparent to those skilled in the art in view of this description. For example, although the methods and storage mediums disclosed herein are emphasized for horizontal oil wells, the methods and storage mediums are not so restricted. In particular, the methods and storage mediums may be used to stimulate any drilled well. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims. The term "approximately" as used herein refers to variations of up to +/−5% of the stated number.

What is claimed is:

1. A method for cleaning wellbore perforation clusters and reservoir fractures, the method comprising:

extending a conduit disposed in a wellbore farther into the wellbore until a forward end of the conduit reaches a first measured depth in the wellbore that is deeper than a designated perforation cluster of the wellbore, wherein the conduit is configured to dispense fluid at its forward end and is further configured to prevent back flow of fluid through at least a majority portion of the conduit;

beginning dispensement of a fluid into the wellbore through the forward end of the conduit subsequent to the forward end of the conduit passing the designated perforation cluster;

retracting the conduit from the first measured depth while dispensing the fluid into the wellbore through the forward end of the conduit and until the forward end of the conduit reaches a second measured depth in the wellbore that is shallower the designated perforation cluster of the wellbore; and moving the conduit from the second measured depth toward the first measured depth while dispensing the fluid into the wellbore.

2. The method of claim 1, further comprising:

stopping the conduit at a third measured depth in the wellbore that is deeper than the designated perforation cluster subsequent to moving the conduit from the second measured depth; and continuing to dispense the fluid into the wellbore at the third measured depth.

3. The method of claim 1, wherein the step of moving the conduit comprises moving the conduit past the designated perforation cluster, and wherein the method further comprises terminating the dispensement of the fluid into the wellbore subsequent to the forward end of the conduit passing the designated perforation cluster.

4. The method of claim 3, further comprising:

introducing a different fluid into the wellbore through the forward end of the conduit subsequent to the step of terminating the dispensement of the fluid into the well bore; and repeating the steps of retracting the conduit and moving the conduit while dispensing the different fluid into the wellbore.

5. The method of claim 4, wherein the conduit is dimensionally configured and arranged within the wellbore such that a passageway exists in the wellbore exterior to the conduit, and wherein the method further comprises:

pumping fluid out of the passageway during the steps of dispensing the fluid into the wellbore, retracting the conduit from the first measured depth, and moving the conduit from the second measured depth; and closing the passageway to impede atmospheric exposure to the passageway prior to or during the step of introducing the different fluid into the wellbore.

6. The method of claim 4, wherein the step of retracting the conduit from the first measured depth while dispensing the different fluid into the wellbore comprises retracting the conduit at a rate such that a rate of volumetric displacement of the conduit within the wellbore is less than 200% of a dispensement rate of the different fluid into the wellbore during the step of retracting the conduit.

7. The method of claim 1, wherein the conduit is dimensionally configured and arranged within the wellbore such that a passageway exists in the wellbore exterior to the conduit, and wherein the method further comprises closing the passageway to impede atmospheric exposure to the passageway prior to or during the step of beginning dispensement of the fluid into the wellbore or subsequent to the step of beginning dispensement of the fluid into the wellbore but prior to the forward end of the conduit reaching the second measured depth.

8. The method of claim 1, further comprising:

removing production tubing from the wellbore;

circulating one or more cleaning fluids through the wellbore subsequent to the step of removing the production tubing; and ceasing supply of the one or more cleaning fluids into the wellbore prior to the step of extending the conduit in the wellbore.

9. The method of claim 1, wherein the fluid is a liquid.

10. The method of claim 1, wherein the fluid is a foam in a liquid state.

11. The method of claim 1, wherein the fluid is a gas.

12. A method for stimulating a wellbore, the method comprising:

removing production tubing from a wellbore;

circulating one or more cleaning fluids through the wellbore subsequent to the step of removing the production tubing;

ceasing supply of the one or more cleaning fluids into the wellbore;

extending a conduit into a lower portion of the wellbore until a forward end of the conduit reaches a first measured depth in the wellbore that is deeper than a designated perforation cluster of the wellbore, wherein the conduit is configured to dispense fluid at its forward end and is further configured to prevent back flow of fluid through at least a majority portion of the conduit, and wherein the conduit is dimensionally configured and arranged within the wellbore such that a passageway exists in the wellbore exterior to the conduit;

introducing a fluid into the wellbore through the forward end of the conduit subsequent to the forward end of the conduit passing the designated perforation cluster and subsequent to the step of ceasing the supply of the one or more cleaning fluids into the wellbore;

closing the passageway to impede atmospheric exposure to the passageway prior to, at the same time or subsequent to the step of introducing the fluid into the wellbore; and continuing to dispense the fluid into the wellbore subsequent to closing the passageway.

13. The method of claim 12, further comprising moving the conduit back and forth between the first measured depth and a second measured depth in the wellbore that is shallower than the designated perforation cluster of the wellbore while dispensing the fluid into the wellbore.

14. The method of claim 13, wherein the step of moving the conduit comprises moving the conduit past the designated perforation cluster, and wherein the method further comprises:

terminating the dispensement of the fluid into the wellbore subsequent to the forward end of the conduit passing the designated perforation cluster during the step of moving the conduit;

introducing a different fluid into the wellbore through the forward end of the conduit subsequent to the step of terminating the dispensement of the fluid into the well bore; and moving the conduit back and forth between the first measured depth and the second measured depth in the wellbore while dispensing the different fluid into the wellbore.

15. The method of claim 12, wherein the fluid is a liquid.

16. The method of claim 12, wherein the fluid is a foam in a liquid state.

17. The method of claim 12, wherein the fluid is a gas.

18. A method for cleaning wellbore perforation clusters and reservoir fractures, the method comprising:

extending a conduit disposed in a wellbore farther into the wellbore until a forward end of the conduit reaches a first measured depth in the wellbore that is deeper than a designated perforation cluster of the wellbore, wherein the conduit is configured to dispense fluid at its forward end and is further configured to prevent back flow of fluid through at least a majority portion of the conduit, and wherein the conduit is dimensionally configured and arranged within the wellbore such that a passageway exists in the wellbore exterior to the conduit;

closing the passageway to impede atmospheric exposure to the passageway subsequent to the forward end of the conduit passing the designated perforation cluster;

subsequent to the step of closing the passageway, repeatedly moving the conduit back and forth between the first measured depth and a second measured depth in the wellbore that is shallower than the designated perforation cluster of the wellbore;

dispensing a first fluid into the wellbore during one cycle of back and forth motion of the conduit; and dispensing a second fluid different from the first fluid into the wellbore during a different cycle of back and forth motion of the conduit.

19. The method of claim 18, further comprising alternately reiterating the steps of dispensing the first and second fluids into the wellbore during subsequent cycles of the back and forth motion of the conduit.

20. The method of claim 18, further comprising dispensing a third fluid different from the first and second fluids into the wellbore during a subsequent cycle of back and forth motion of the conduit.

21. The method of claim 18, wherein the first fluid is a gas or a foam in a liquid state, and wherein the second fluid is a liquid.

22. The method of claim 18, further comprising:

removing production tubing from the wellbore;

circulating one or more cleaning fluids through the wellbore subsequent to the step of removing the production tubing; and ceasing supply of the one or more cleaning fluids into the wellbore prior to the step of extending the conduit in the wellbore.

* * * * *